US008358962B2

(12) United States Patent
Sugiyama et al.

(10) Patent No.: US 8,358,962 B2
(45) Date of Patent: Jan. 22, 2013

(54) IMAGE RECORDING APPARATUS INCLUDING SWINGABLE PATH CHANGEOVER UNIT

(75) Inventors: Wataru Sugiyama, Aichi-ken (JP); Takashi Ohama, Iwakura (JP); Noriyuki Kawamata, Nagoya (JP); Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 659 days.

(21) Appl. No.: 12/039,286

(22) Filed: Feb. 28, 2008

(65) Prior Publication Data

US 2008/0205954 A1 Aug. 28, 2008

(30) Foreign Application Priority Data

Feb. 28, 2007 (JP) ..... 2007-050775
Feb. 28, 2007 (JP) ..... 2007-050802

(51) Int. Cl.
*G03G 15/00* (2006.01)
*B65H 29/00* (2006.01)

(52) U.S. Cl. ..... 399/401; 399/397; 399/405; 271/184; 271/185; 271/225; 271/291

(58) Field of Classification Search ..... 399/401, 399/373, 364, 405, 397; 347/101, 104; 271/293, 271/301, 184, 185, 186, 225, 291
See application file for complete search history.

(56) References Cited

U.S. PATENT DOCUMENTS 6,892,048 B2 5/2005 Eskey
6,909,872 B2 6/2005 Eskey
7,177,587 B2 2/2007 Sugata
7,614,738 B2 * 11/2009 Takeuchi ..... 347/104
7,725,071 B2 * 5/2010 Izuchi et al. ..... 399/401
2003/0063175 A1 4/2003 Nishikawa
2006/0268089 A1 11/2006 Takeuchi
2006/0279622 A1 12/2006 Kao
2007/0008394 A1 1/2007 Mashima
2007/0122225 A1 5/2007 Izuchi et al.

FOREIGN PATENT DOCUMENTS

JP 11-079566 A 3/1999
JP H11-209008 A 8/1999
JP 2003-095507 A 4/2003

(Continued)

OTHER PUBLICATIONS

Machine translation of JP 2004250222.*

(Continued)

*Primary Examiner* — Matthew G Marini
(74) *Attorney, Agent, or Firm* — Baker Botts L.L.P.

(57) ABSTRACT

In an image recording apparatus according to an aspect of the invention, a recording medium is allowed to be conveyed on a conveying path. An inversion guide portion connects a first portion of the conveying path positioned downstream of a recording unit to a second portion of the conveying path positioned upstream of the recording unit. A path changeover unit is disposed at the first portion of the conveying path and swingable between a recording medium discharge position and a recording medium inversion position. When the path changeover unit is positioned at the recording medium discharge position, the forward rotation of the roller pair allows the recording medium to be sent to a discharge portion. When the path changeover unit is positioned at the recording medium inversion position, the rearward rotation of the roller pair allows the recording medium to be sent to the inversion guide portion.

28 Claims, 11 Drawing Sheets

FOREIGN PATENT DOCUMENTS

| | | | | |
|---|---|---|---|---|
| JP | 2003095507 | A | | 4/2003 |
| JP | 2003226053 | A | | 8/2003 |
| JP | 2004170942 | A | | 6/2004 |
| JP | 2004224057 | A | | 8/2004 |
| JP | 2004-250222 | A | | 9/2004 |
| JP | 2004250222 | A | * | 9/2004 |
| JP | 2005-104728 | A | | 4/2005 |
| JP | 2006327793 | A | | 12/2006 |
| JP | 2007145574 | A | | 6/2007 |

OTHER PUBLICATIONS

Japanese Patent Office, Office Action issued in corresponding Japanese Application No. 2007-050775, dated Jan. 20, 2009.

European Patent Office, European Search Report for Related EP Application No. 08003606 dated May 2, 2008.

Patent Reexamination Board of the Chinese Patent Office, Notification of Reexamination for Chinese Patent Application No. 200810082037.8 (counterpart to above-captioned patent application), issued Feb. 14, 2012.

* cited by examiner

IMAGE RECORDING APPARATUS INCLUDING SWINGABLE PATH CHANGEOVER UNIT

CROSS-REFERENCE TO RELATED APPLICATIONS

This application is based upon and claims the benefit of priority from Japanese Patent Application No. 2007-050775 filed on Feb. 28, 2007 and Japanese Patent Application No. 2007-050802 filed on Feb. 28, 2007, the entire contents of which are incorporated herein by reference.

TECHNICAL FIELD

The present invention relates to an image recording apparatus capable of performing a double-sided printing on a recording medium by inverting a recording medium inside out.

BACKGROUND

There is an image recording apparatus capable of performing a double-sided printing for recording an image on both sides of a recording sheet. The image recording apparatus of this type feeds a recording sheet from a sheet feeding tray and conveys the fed sheet along a conveying path formed in the U-shape. A recording unit is disposed along the conveying path, and the recording unit records an image on either side (either a front side or a rear side) of the recording sheet being conveyed. When an image is to be recorded on only one side, the recording sheet on which an image has been recorded is sent toward downstream side of the conveying path and then discharged. On the other hand, when images are to be recorded on both sides, the recording sheet of which an image has been recorded on one side is temporarily returned to an inversion guide path and is then again sent upstream side (a position upstream of the recording unit) of the conveying path. The recording unit records an image on the other side (any of the front side and the rear side) of the inverted recording sheet, and the recorded sheet is discharged later. This kind of the image recording apparatus is disclosed in, for example, JP-A-2004-224057.

Incidentally, in the above image recording apparatus, a flap is disposed at a branch point between a conveying path and an inversion path, and a recording sheet is sent downstream along the conveying path or returned to the inversion path by means of pivotal movement of the flap. When the recording sheet is to be returned to the inversion path, the flap closes an upstream portion of the conveying path, thereby forming a guide plate for guiding the recording sheet to the inversion path. As a result of a pair of discharge rollers for discharging the recording sheet being rearwardly rotated, an end of the recording sheet is pressed against the flap, to thus enter the inversion path while being elastically bent.

However, when the recording sheet is pressed against the flap so as to become elastically deformed, a part of drive force developing from the pair of discharge rollers is expended by elastic deformation of the recording sheet, so that the force for conveying a sheet decreases.

When drive force of the pair of discharge rollers is set to a larger value in order to address such a circumstance, a motor for driving the pair of drive rollers, or the like, becomes bulky, which increases in the overall size of the image recording apparatus.

In addition, a portion of the recording sheet located downstream of the discharge rollers is oriented in a direction parallel to the inversion path due to stiffness of the recording sheet, and hence wrapping of the recording sheet around the discharge rollers becomes weak. As mentioned above, when wrapping becomes weak, conveyance of the recording sheet performed by the discharge rollers may become unstable.

SUMMARY

Accordingly, an object of one aspect of the present invention is to provide a light-weight, compact image recording apparatus capable of inverting a recording sheet reliably and smoothly.

According to a first aspect of the invention, there is provided an image recording apparatus comprising: a conveying path on which a recording medium is allowed to be conveyed in a conveying direction; a feeding unit configured to feed the recording medium to the conveying path; a recording unit disposed in the conveying path and configured to record an image on the recording medium; a sheet discharging portion disposed downstream of the recording unit with respect to the conveying direction; an inversion guide portion that connects a first portion of the conveying path positioned downstream of the recording unit to a second portion of the conveying path positioned upstream of the recording unit; and a path changeover unit disposed at the first portion of the conveying path and swingable between a recording medium discharge position and a recording medium inversion position, the path changeover unit comprising: a roller pair comprising a first roller and a second roller and configured to nip the recording medium and to perform a forward rotation and a rearward rotation; and an third roller disposed upstream of the roller pair with respect to the conveying direction, wherein the path changeover unit is swingable around one of the roller pair, wherein, when the path changeover unit is positioned at the recording medium discharge position, the forward rotation of the roller pair allows the recording medium nipped by the roller pair to be sent to the discharge portion, wherein, when the path changeover unit is positioned at the recording medium inversion position, the rearward rotation of the roller pair allows the recording medium nipped by the roller pair to be sent to the inversion guide portion.

According to a second aspect of the invention, there is provided an image recording apparatus comprising: a conveying path on which a recording medium is allowed to be conveyed in a conveying direction; a feeding unit configured to feed the recording medium to the conveying path; a recording unit disposed in the conveying path and configured to record an image on the recording medium; a sheet discharging portion disposed downstream of the recording unit with respect to the conveying direction; an inversion guide portion that connects a first portion of the conveying path positioned downstream of the recording unit to a second portion of the conveying path positioned upstream of the recording unit; a path changeover unit disposed at the first portion and comprising a roller pair comprising a first roller and a second roller and configured to nip the recording medium and to perform a forward rotation and a rearward rotation, the forward rotation that allows the recording medium nipped by the roller pair to be sent to the discharge portion, and the rearward rotation that allows the recording medium nipped by the roller pair to be sent to the inversion guide portion; and a guide disposed downstream of the path changeover unit with respect to the conveying direction, wherein the guide is positioned so that the guide contacts with a recording surface of the recording medium when the recording medium is sent to the inversion guide portion as a result of rearward rotation of the roller pair, and that is non-contact with the recording surface of the recording medium when the recording medium is sent to the sheet discharging portion as a result of forward rotation of the roller pair.

DESCRIPTION

The illustrative embodiments of the invention will be described in detail with reference to drawings, as appropriate. The embodiments simply show examples and can be changed appropriately within a scope of the present invention.

1. Overall Configuration and Characteristic Points of the Embodiments

Figure 1:
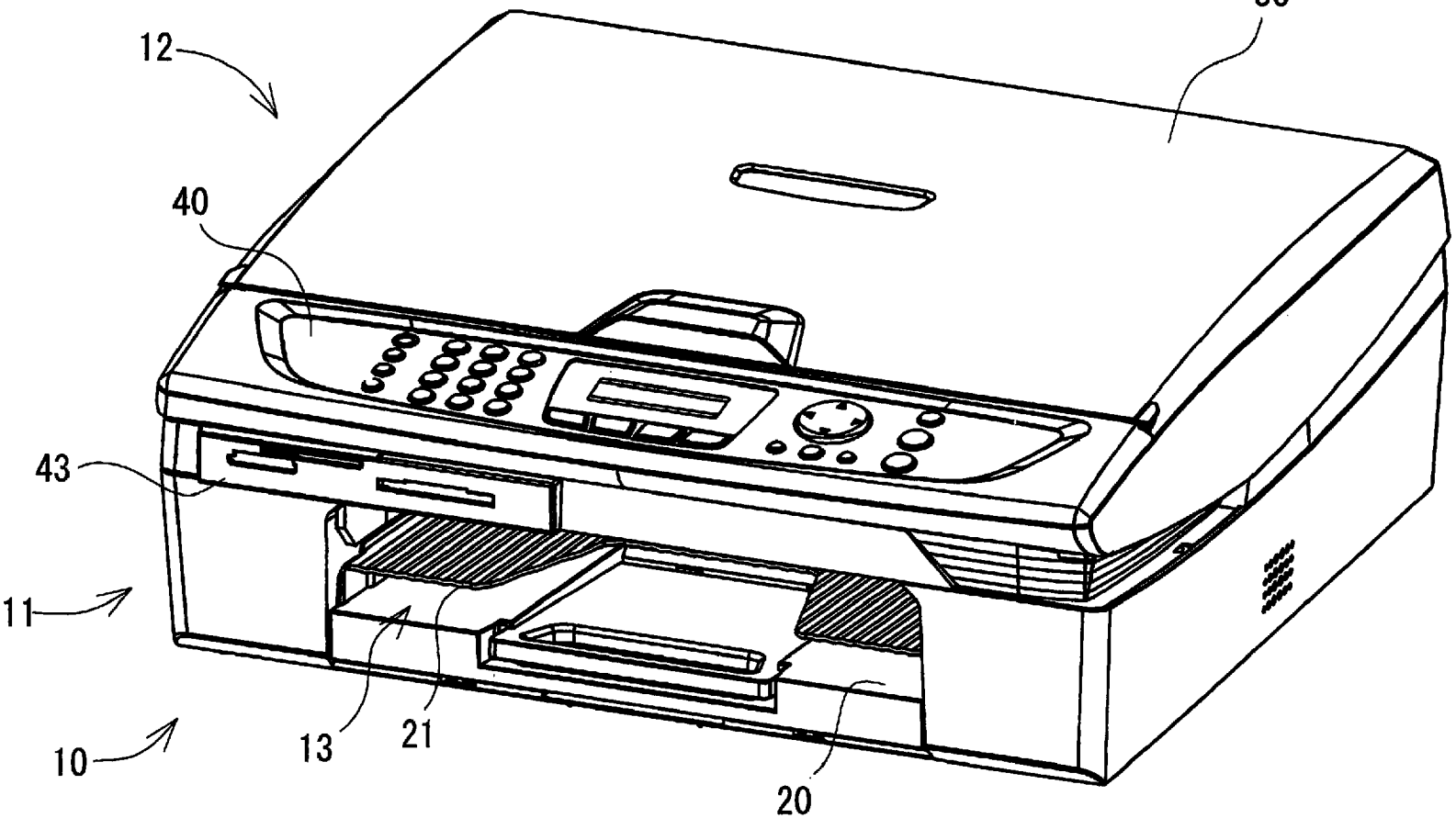
FIG. 1 is an external perspective view of a multi function device of an embodiment of the present invention.
Figure 2:
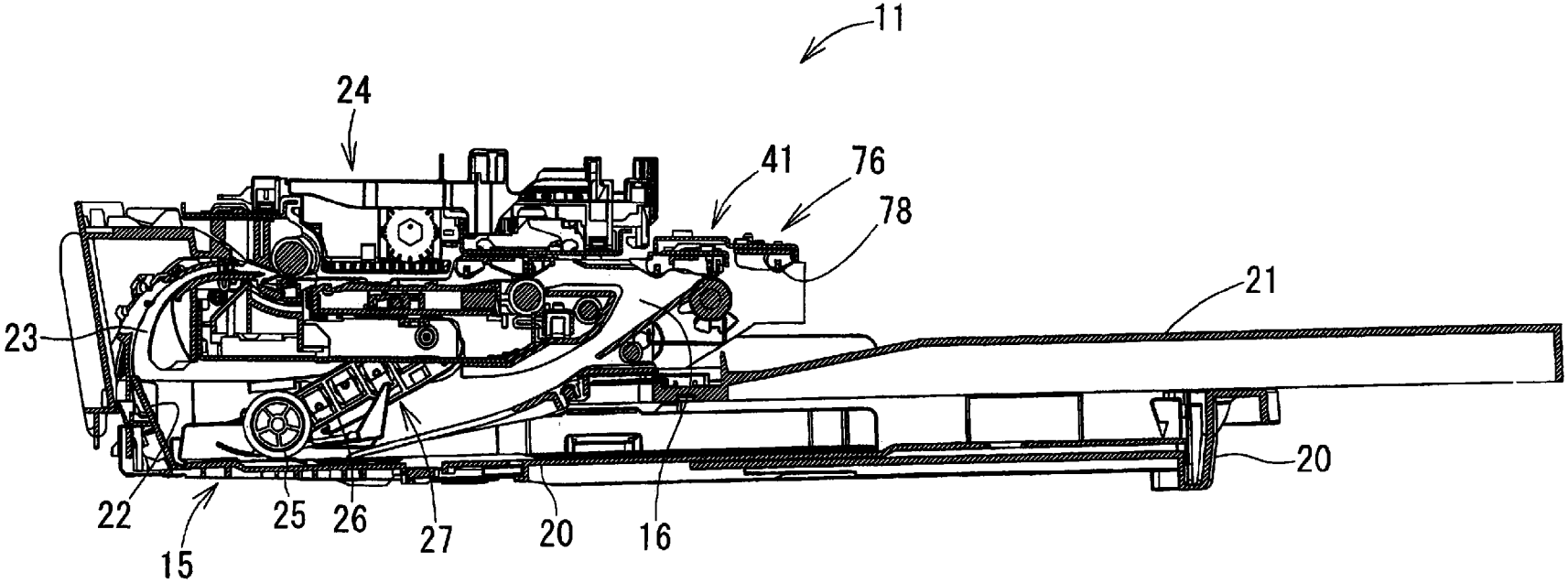
FIG. 2 is a longitudinal cross-sectional view of the multi function device of the embodiment of the present invention.

FIG. 1 is an external perspective view of a multi function device 10 of one embodiment of the present invention. FIG. 2 is a longitudinal cross-sectional view showing the structure of a printer unit 11 of the multi function device 10.

The multi function device (MFD) 10 includes the printer unit 11 and a scanner unit 12 and has a printer function, a scanner function, a copier function, and a facsimile function. An image recording apparatus of the present invention is implemented as the printer unit 11 of the multi function device 10. Consequently, the functions of the multi function device 10 except the printer function are arbitrary.

As shown in FIG. 1, a lower portion of the multi function device 10 corresponds to the printer unit 11. As shown in FIG. 2, a conveying path 23 and an inversion guide portion 16 are formed in the printer unit 11. A recording sheet serving as a recording medium is conveyed along the conveying path 23. The printer unit 11 includes a feeding unit 15 for feeding a recording sheet to the conveying path 23; a recording unit 24 for recording an image on the recording sheet; and a sheet discharging tray 21 serving as a sheet discharging portion. The multi function device 10 can record images on both sides of the recording sheet. When an image is recorded on the rear side of the recording sheet, the recording sheet with an image recorded on a front side thereof is returned from the conveying path 23 to the inversion guide portion 16. Specifically, the recording sheet is again sent to the conveying path 23 and turned inside out, and the recording unit 24 records an image on the rear side of the inverted recording sheet. The multi function device 10 of the present embodiment includes a path changeover unit 41. The path changeover unit 41 reliably, smoothly guides the recording sheet to the inversion guide portion 16 when double-sided recording is performed. The recording sheet with an image recorded thereon is discharged to the sheet discharging tray 21. The sheet discharging tray 21 is adjacent to a downstream side of the conveying path 23 with respect to the conveying direction.

In addition, the multi function device 10 of the present embodiment includes a guide unit 76 and a path changeover unit 41. The path changeover unit 41 reliably, smoothly guides a recording sheet to the inversion guide portion 16 when double-sided recording is performed. The guide unit 76 contacts the recording surface of the recording sheet, whereupon the recording sheet is deflected. As a result, the recording sheet is wrapped around the first roller 45 and the second roller 46 (see FIG. 4), which will be described later. Hence, the recording sheet is sent to the inversion guide portion 16 without fail. The recording sheet having finished undergoing recording of an image is discharged to the sheet discharging tray 21. The sheet discharging tray 21 is adjacent to the downstream side of the conveying path 23 with respect to the conveying direction.

As shown in FIG. 1, an upper portion of the multi function device 10 corresponds to the scanner unit 12. The scanner unit 12 is configured as a so-called flatbed scanner. A document cover 30 is provided as a top plate of the multi function device 10. Although unillustrated, platen glass is disposed beneath the document cover 30. A document can be put on the platen glass and read as an image while being covered with the document cover 30.

An operation panel 40 is provided in a front upper portion of the multi function device 10. The operation panel 40 is a device for operating the printer unit 11 and the scanner unit 12. The multi function device 10 further includes a slot unit 43. Various compact memory cards serving as storage media can be inserted into the slot unit 43. For instance, as a result of the user operating the operation panel 40 while a compact memory card is inserted in the slot unit 43, data such as image data stored in the compact memory card are read and recorded on a recording sheet.

2. Printer Unit

The internal configuration of the multi function device 10; particularly the configuration of the printer unit 11, will be described hereunder.

(2-1 Feeding Unit)

As shown in FIG. 1, an opening 13 is formed in the front of the printer unit 11. A sheet feeding tray 20 and the sheet discharging tray 21 are provided in two layers within the opening 13. As shown in FIG. 2, the feeding unit 15 includes the sheet feeding tray 20, a sheet feeding arm 26 and a sheet feeding roller 25, and a power transmission mechanism 27 for driving the sheet feeding roller 25.

The sheet feeding tray 20 stores recording sheets. The recording sheets stored in the sheet feeding tray 20 are fed to the inside of the printer unit 11. The sheet feeding tray 20 is disposed on the bottom side of the printer unit 11. A separation tilt plate 22 is provided at a deep position of the sheet feeding tray 20. The separation tilt plate 22 is contiguous with the conveying path 23. The separation tilt plate 22 separates recording sheets sent in an overlaid manner from the sheet feeding tray 20 and upwardly guides the top recording sheet. The conveying path 23 extends upwardly from the separation tilt plate 22 and is then curved to the front in the shape of the letter U. The conveying path 23 extends from the back (the left side in FIG. 2) of the multi function device 10 to the front (the right side in FIG. 2) and comes into mutual communication with the sheet discharging tray 21 by way of the recording unit 24. Consequently, the recording sheet stored in the sheet feeding tray 20 is guided from down to up along the sheet conveying path 23 so as to make a U-turn; reaches the recording unit 24 and undergoes image recording performed by the recording unit 24; and is discharged to the sheet discharging tray 21.

Figure 3:
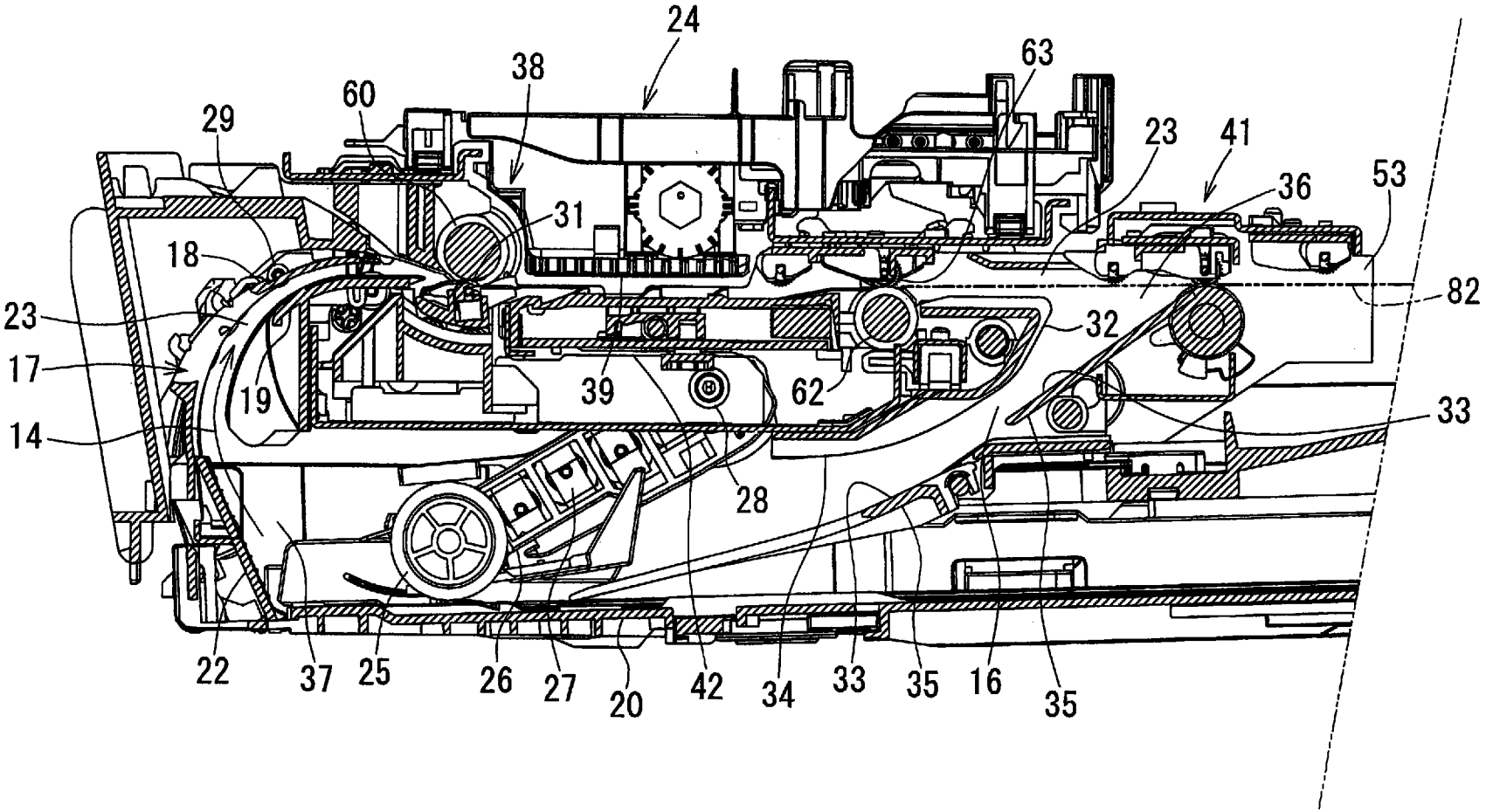
FIG. 3 is a partially-enlarged cross-sectional view of the multi function device of the embodiment of the present invention.

FIG. 3 is a partially-enlarged cross-sectional view of the printer section 11.

As shown in FIG. 3, the sheet feeding roller 25 is disposed at an upper portion of the sheet feeding tray 20. The sheet feeding roller 25 feeds the recording sheet placed on the sheet feeding tray 20 to the conveying path 23. The sheet feeding roller 25 is pivotally supported by the leading edge of the sheet feeding arm 26. The sheet feeding roller 25 is rotationally driven by means of a motor (not shown) as a drive source, by way of the power transmission mechanism 27. The power transmission mechanism 27 includes a plurality of gears and is configured as a result of engagement of the gears.

The sheet feeding arm 26 is supported by a base axis 28. A base end portion of the sheet feeding arm 26 is supported by the base axis 28, and the sheet feeding arm 26 can rotate while taking the base axis 28 as a rotational center. Therefore, the sheet feeding arm 26 can ascend or descend so as to be able to contact or depart from the sheet feeding tray 20. The sheet feeding arm 26 is urged under its own weight or by means of a spring, or the like, to thus become pivotally urged in a downward direction. Therefore, the sheet feeding arm 26 usually contacts the sheet feeding tray 20 and is arranged so as to recede upwardly at the time of removal of the sheet feeding tray 20. As a result of the sheet feeding arm 26 being rotationally urged in the downward direction, the sheet feeding roller 25 comes into press-contact with the recording sheet on the sheet feeding tray 20. When the sheet feeding roller 25 is rotated in that state, the top recording sheet is fed toward the separation tilt plate 22 by means of frictional force developing between a roller surface of the sheet feeding roller 25 and the recording sheet. When the leading edge of the recording sheet contacts the separation tilt plate 22, the recording sheet is guided upwardly and sent to the conveying path 23 along an arrow 14. When the top recording sheet is fed by the sheet feeding roller 25, a recording sheet (second recording sheet) located immediately below the top recording sheet may be fed along with the top recording sheet by means of friction or static electricity. However, the second recording sheet is prevented from being fed by contacting with the separation tilt plate 22.

The conveying path 23 is partitioned into an outer guide surface and an inner guide surface except an area where the recording unit 24 or the like is disposed. For instance, a curved portion 17 of the conveying path 23 on the back of the multi function device 10 is formed by an outer guide member 18 and an inner guide member 19 being fixed to a frame of the recording apparatus. In this case, the outer guide member 18 forms the outer guide surface, and the inner guide member 19 forms the inner guide surface. The outer guide member 18 and the inner guide member 19 are disposed opposite each other while being spaced with a predetermined interval from each other. A roller 29 is disposed at a location where the conveying path 23 is curved. The roller 29 is freely rotatable. A roller surface of the roller 29 is exposed through the outer guide surface. Consequently, the recording sheet is smoothly conveyed even at a location where the conveying path 23 is curved.

(2-2 Recording Unit)

As illustrated, the recording unit 24 is placed in the conveying path 23. The recording unit 24 includes a carriage 38 and an inkjet recording head 39. The inkjet recording head 39 is mounted on the carriage 38. The carriage 38 moves back and forth with respect to a main scanning direction (a direction perpendicular to a drawing sheet of FIG. 3). An ink cartridge is provided in the multi function device 10 independently of the inkjet recording head 39. Any ink cartridge is not shown in FIG. 3. Ink is supplied from the ink cartridge to the inkjet recording head 39 by way of an ink tube. During reciprocal movement of the carriage 38, ink is ejected as minute ink droplets from the inkjet recording head 39, whereby an image is recorded on a recording sheet conveyed over a platen 42.

(2-3 Inversion Guide Portion)

The inversion guide portion 16 is connected to the conveying path 23. The inversion guide portion 16 is contiguous with a downstream portion 36 (an example of a first portion) of the conveying path 23 with respect to the recording unit 24. The inversion guide portion 16 constitutes an inversion path for again guiding onto the sheet feeding tray 20 a recording sheet with an image recorded on one side (surface) thereof. The inversion path is partitioned into a first guide surface 32 and a second guide surface 33. In the present embodiment, the first guide surface 32 is formed from a surface of a guide member 34 disposed in the body frame of the multi function device 10, and the second guide surface 33 is formed from a surface of a guide member 35 disposed in the body frame 53 of the multi function device 10. The guide members 34 and 35 are disposed opposite each other while being separated from each other by a predetermined interval. The first guide surface 32 and the second guide surface 33 extend obliquely in a downward direction from the downstream portion 36 of the conveying path 23 toward the sheet feeding roller 25.

Therefore, the recording sheet with an image recorded on the surface thereof is again sent to an upstream portion 37 (an example of a second portion) of the conveying path 23 by means of the sheet feeding roller 25. The recording sheet is conveyed in the shape of the letter U along the direction of an arrow 14, as mentioned previously, whereby an image is recorded on the other surface (a rear side) by means of the recording unit 24. In the present embodiment, the inversion guide portion 16 is configured so as to return the recording sheet onto the sheet feeding tray 20 but is not limited to such a configuration. In short, the inversion guide portion 16 may connect the downstream portion 36 of the conveying path 23 to the upstream portion 37. Consequently, the recording sheet may be returned to a position closer to the sheet feeding tray 20 rather than to the upstream portion 37.

(2-4 Sheet Conveying System)

As shown in FIG. 3, the conveying roller 60 and the pinch roller 31 are provided at an upstream side of the conveying path 23 with respect to the recording unit 24. The rollers 60 and 31 pair up with each other, and the pinch roller 31 is disposed so as to come into press-contact with a lower side of the conveying roller 60. The conveying roller 60 and the pinch roller 31 send the recording sheet conveyed on the conveying path 23 onto the platen 42 while nipping the recording sheet. The discharge roller 62 and the spur roller 63 are disposed on a downstream side of the conveying path 23 with respect to the recording unit 24. The discharge roller 62 and the spur roller 63 convey the recorded sheet toward a further downstream side (toward the sheet discharging tray 21) in the conveying direction with respect to the conveying path 23 while nipping the recording sheet. The conveying roller 60 and the discharge roller 62 are driven while the motor is taken as a drive source. Driving of the conveying roller 60 and driving of the discharge roller 62 are synchronized with each other and are intermittently driven. As a result, a recording sheet is sent at a predetermined carriage return width. Although unillustrated in the drawing, the conveying roller 60 is provided with the rotary encoder. The rotary encoder detects, by use of an optical sensor, a pattern of an encoder disk (not shown) that rotates along with the conveying roller 60. In accordance with a detection signal, rotation of the conveying roller 60 and rotation of the discharge roller 62 are controlled.

The spur roller 63 comes into press-contact with the recorded recording sheet. A roller surface of the spur roller 63 is made uneven in the shape of a spur so as not to deteriorate an image recorded on the recording sheet. The spur roller 63 is provided to slidably move in a direction to contact or depart from the discharge roller 62. The spur roller 63 is urged so as to come into press-contact with the discharge roller 62. A coil spring is typically adopted as a unit for urging the spur roller 63 against the discharge roller. When a recording sheet has entered between the discharge roller 62 and the spur roller 63, the spur roller 63 recedes to a distance equal to the thickness of the recording sheet in defiance of urging force of the coil spring. The recording sheet is brought into press-contact with the discharge roller 62, and torque of the discharge roller 62 is transmitted to the recording sheet without fail. Moreover, the pinch roller 31 is also elastically urged against to the conveying roller 60 in the same manner. Consequently, the recording sheet is brought into press-contact with the conveying roller 60, rotational force of the conveying roller 60 is transmitted to the recording sheet without fail.

In the multi function device 10, the motor serves as a drive source for feeding a recording sheet from the sheet feeding tray 20 and also as a drive source for conveying a recording sheet situated on the platen 42 and discharging a recorded recording sheet to the sheet discharging tray 21. Specifically, the motor drives the conveying roller 60, as well as driving the sheet feeding roller 25 by way of the drive transmission mechanism 27 as mentioned previously. Moreover, the motor is arranged to drive the discharge roller 62 by way of a predetermined power transmission mechanism. The power transmission mechanism may also include, for example, a train of gears; or a timing belt or the like may also be used in the light of assembly space.

(2-5 Path Changeover Unit)

Figure 4:
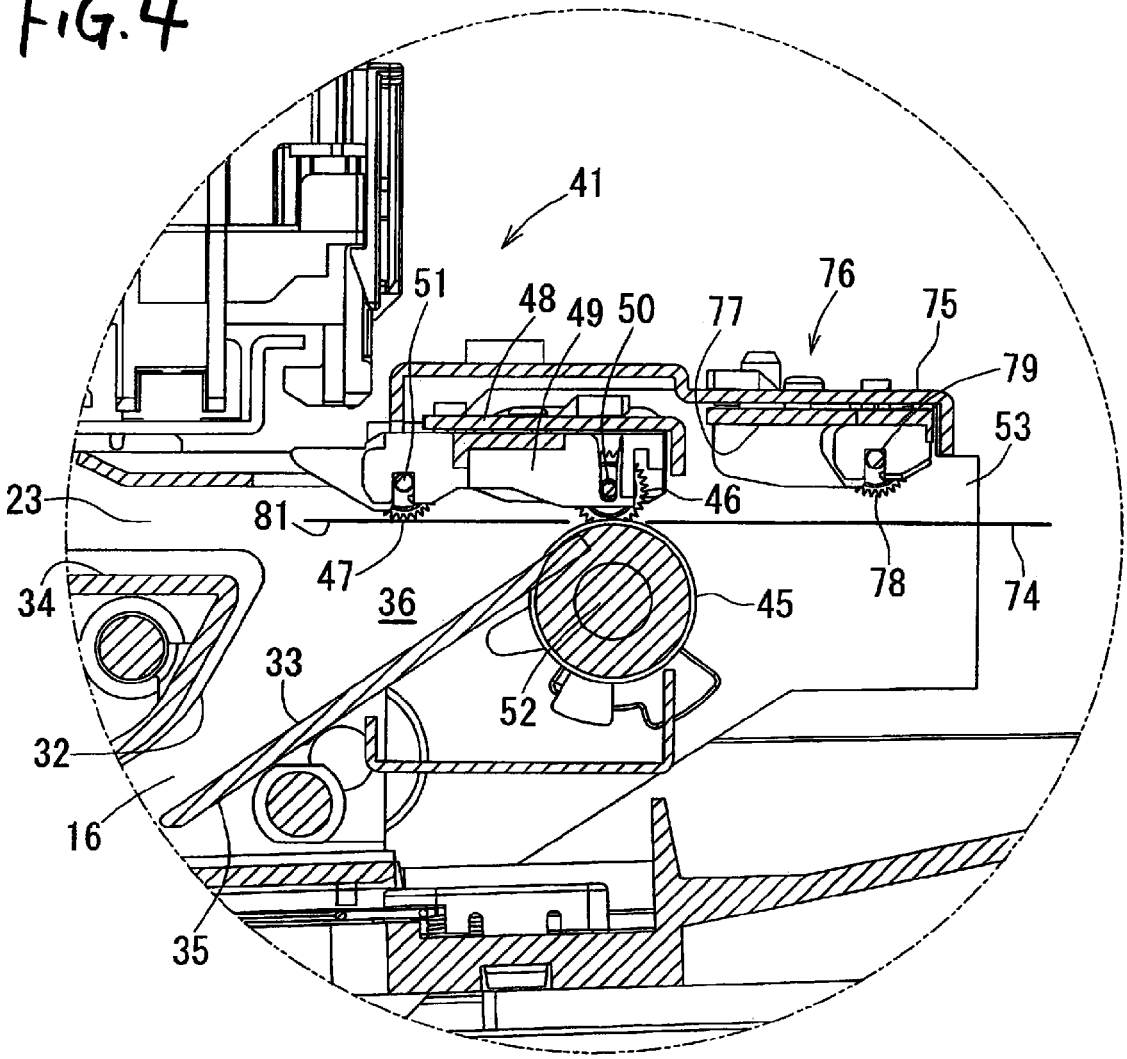
FIG. 4 is an enlarge view of the principal portion shown in FIG. 3.
Figure 5:
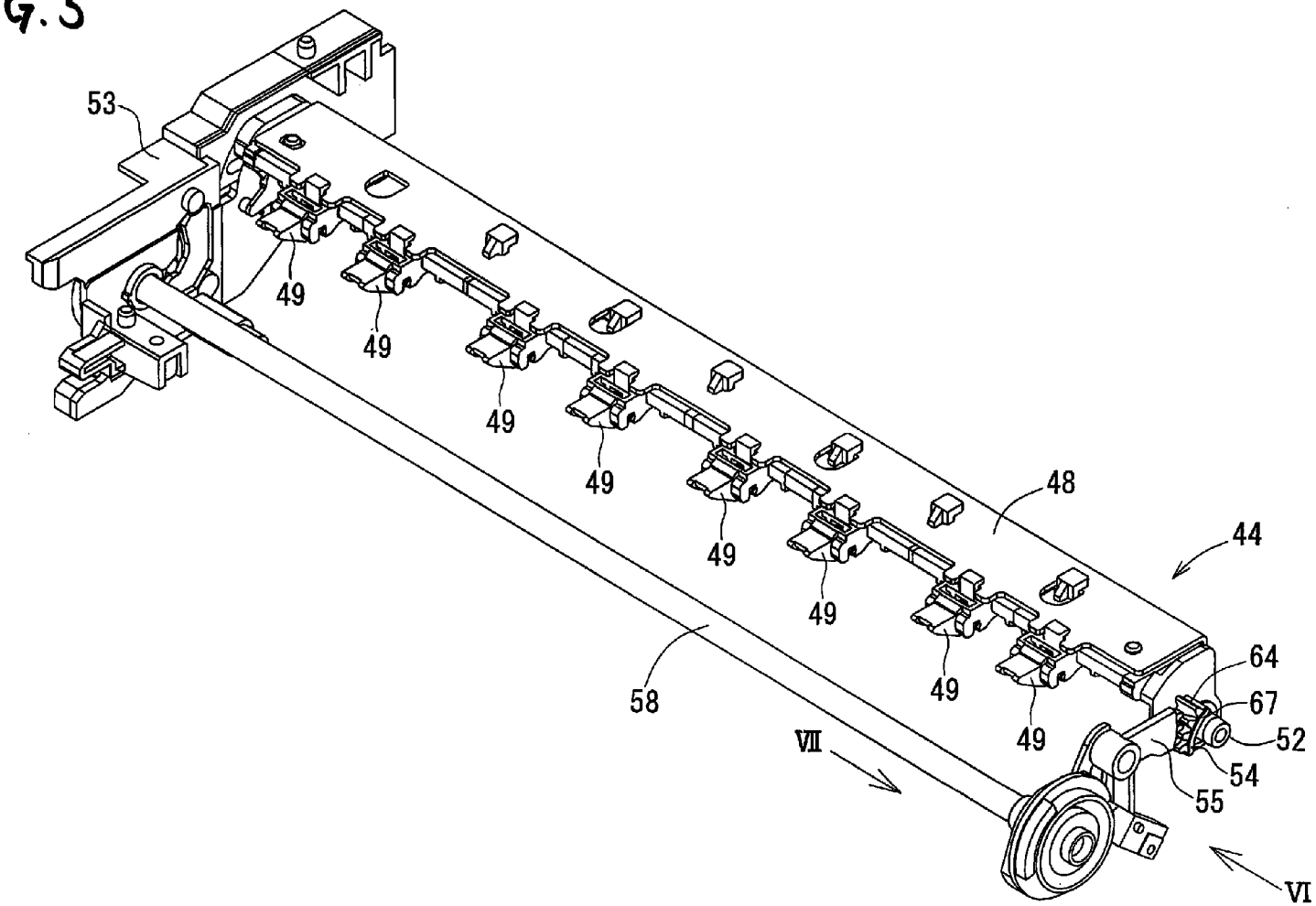
FIG. 5 is a perspective view of a drive mechanism of a path changeover unit according to the embodiment of the present invention.
Figure 6:
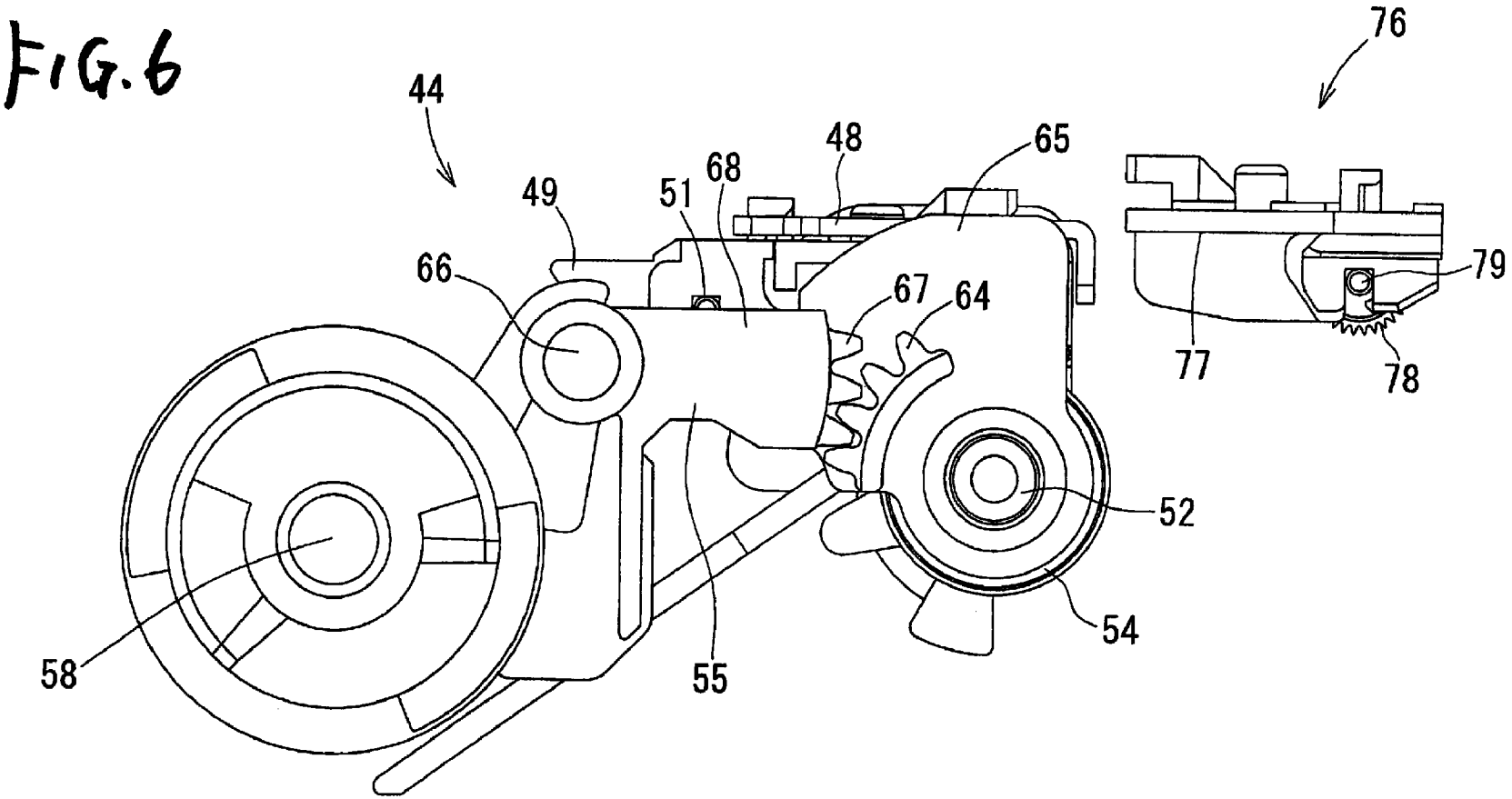
FIG. 6 is a side view of the drive mechanism when viewed in the direction of arrow VI shown in FIG. 5.
Figure 7:
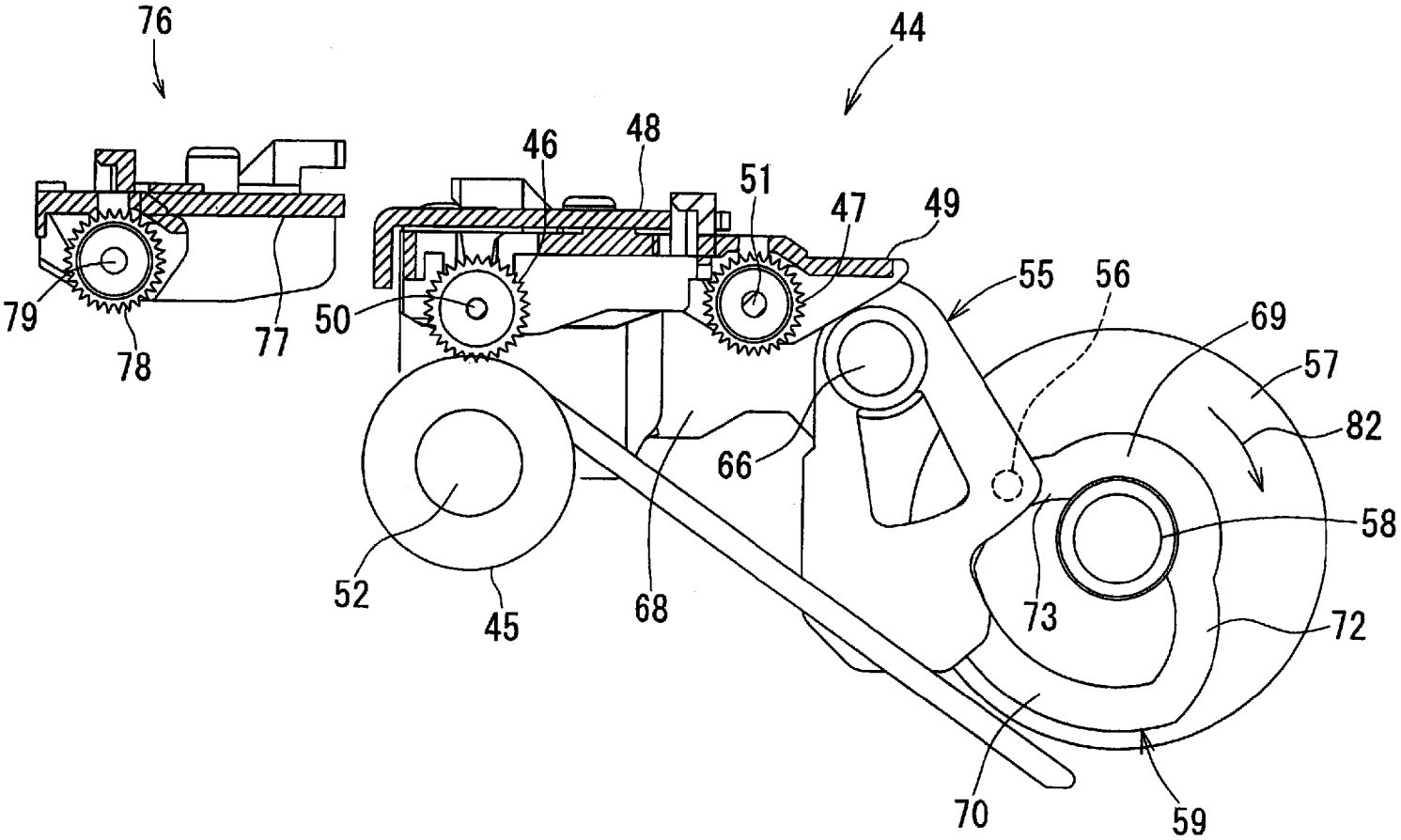
FIG. 7 is a partially-cross-sectional side view of the drive mechanism when viewed in the direction of arrow VII shown in FIG. 5.

FIG. 4 is an enlarge view of the principal unit shown in FIG. 3, showing in detail a cross-sectional structure of the path changeover unit 41. FIG. 5 is a perspective view of a drive mechanism 44 of the path changeover unit 41. FIG. 6 is a side view of the drive mechanism when viewed in the direction of arrow VI shown in FIG. 5, and FIG. 7 is a side view of the drive mechanism when viewed in the direction of arrow VII shown in FIG. 5.

As shown in FIGS. 3 and 4, the path changeover unit 41 is disposed at a position in the conveying path 23 which is downstream of the recording unit 24. Specifically, the path changeover unit 41 is positioned at the downstream portion 36; namely, a place that is in a boundary between the conveying path 23 and the inversion guide portion 16 and that is downstream in the conveying direction. The path changeover unit 41 includes a pair of rollers including the first roller 45 and the second roller 46, and an auxiliary roller 47 disposed beside the second roller 46. The auxiliary roller 47 serves as an example of a third roller. The second roller 46 and the auxiliary roller 47 are attached to a frame 48. The auxiliary roller 47 is positioned so that the circumference of the auxiliary roller contacts a tangent line to the first roller 46 or the second roller 47 at a contact point of the first roller 46 and the second roller 47. The frame 48 extends in a lateral direction of the multi function device 10 (a direction perpendicular to a drawing sheet of FIG. 3). A cross-sectional profile of the frame 48 is formed essentially in the shape of the letter L, as shown in FIG. 4, whereby bending rigidity of the frame 48 is ensured.

As shown in FIGS. 4 and 5, the frame 48 includes eight sub-frames 49. The frame 48 and the sub-frames 49 serve as an example of a support member. The respective sub-frames 49 are arranged symmetrical in the lateral direction with respect to the center of the multi function device 10. Each of the sub-frames 49 has one second roller 46 and one auxiliary roller 47. Therefore, the frame 48 eventually includes eight second rollers 46 and eight auxiliary rollers 47. The second roller 46 is supported by a support axis 50 provided in each of sub-frames 49 (see FIG. 4) so as to be rotatable around the support axis 50, and the auxiliary roller 47 is supported by a support axis 51 (see FIG. 4) provided in each sub-frame 49 so as to be rotatable around the support axis 51. In the present embodiment, the second roller 46 and the auxiliary roller 47 are formed into the shape of a spur. The auxiliary roller 47 is disposed upstream of the second roller 46 in the conveying direction while being spaced apart from each other by a predetermined distance. The respective second rollers 46 are urged downwardly in FIG. 4 by means of unillustrated springs as an elastic member. Consequently, the respective second rollers 46 are always elastically pressed against the first roller 45.

The first roller 45 is rotated by means of taking the motor as a drive source. Although unillustrated in the respective drawings, the first roller 45 is coupled to the motor by way of a drive transmission mechanism. As shown in FIG. 5, the first roller 45 has a center axis 52 serving as an example of a first axis. The center axis 52 is supported by the body frame 53 of the multi function device 10. The drive transmission mechanism (not shown) is connected to the center axis 52. Brackets may also be provided on the center axis 52. As a result of the brackets being fastened to the body frame 53 by means of, for example, screws, the center axis 52 is reliably supported by the body frame 53.

The second rollers 46 are provided on the first roller 45. The first roller 45 may also be formed into a single elongated columnar shape, and the eight rollers may also be disposed opposite the respective second rollers 46. The first roller 45 is rotated forwardly and rearwardly by means of the motor. The recording sheet conveyed along the conveying path 23 is nipped between the first roller 45 and the second rollers 46. When the first roller 45 is forwardly rotated, the recording sheet is conveyed downstream in the conveying direction while being nipped between the first roller 45 and the second rollers 46 and discharged to the sheet discharging tray 21. In contrast, when the first roller 45 is rearwardly rotated, the recording sheet is returned upstream in the conveying direction while being nipped between the first roller 45 and the second rollers 46.

As shown in FIGS. 5 through 7, the drive mechanism 44 includes follower gears 54 provided around the center axis 52, drive gears 55 meshing with the respective follower gears 54; and a guide plate 57 coupled to the respective drive gears 55 by way of pins 56. The guide plate 57 is illustrated only in FIG. 7. The guide plate 57 is provided with a rotational drive shaft 58, and the rotational drive shaft 58 is driven by means of taking the motor as a drive source. As shown in FIG. 7, the guide plate 57 has a guide groove 59. The guide groove 59 is annularly formed around the rotational drive shaft 58. Each of the guide grooves 59 has a small circular-arc portion 69 (an example of a first arc portion) and a large circular-arc portion 70 (an example of a second arc portion), which are centered on the rotational drive shaft 58; a joint groove 72 (an example of a joint portion) for connecting one end of the small circular-arc portion 69 and one end of the large circular-arc portion 70 together; and a joint groove 73 (an example of a joint portion) for connecting the other end of the small circular-arc portion 69 and the other end of the large circular-arc portion 70 together. The pins 56 are fitted in the respective guide grooves 59 and slidably move along the guide grooves 59.

As shown in FIGS. 5 and 6, each of the follower gears 54 has a tooth portion 64 and a flange portion 65. The tooth portions 64 are configured as in the form of an involute gear centered on the center axis 52. The tooth portions 64 are fitted around the center axis 52 and can rotate around the center axis 52. The flange portions 65 are formed integrally with the tooth portions 64, to thus become connected to the frame 48. Therefore, when the tooth portions 64 are rotated, the frame 48, the sub-frames 49, the second rollers 46, and the auxiliary rollers 47 integrally rotate around the center axis 52.

The drive gears 55 are rotatably supported by a support axis 66 serving as an example of a second axis. The support axis 66 is provided on the body frame 53. Each of the drive gears 55 has a tooth portion 67 and an arm 68. The pin 56 is protrudingly provided on each arm 68. The tooth portion 67 is configured in the form of an involute gear centered on the support axis 66 and meshes with the tooth portions 64. The tooth portions 64 rotate as a result of rotation of the tooth portion 67, and, consequently, the frame 48, the sub-frames 49, the second rollers 46, and the auxiliary rollers 47 rotate integrally around the center axis 52.

Figure 8:
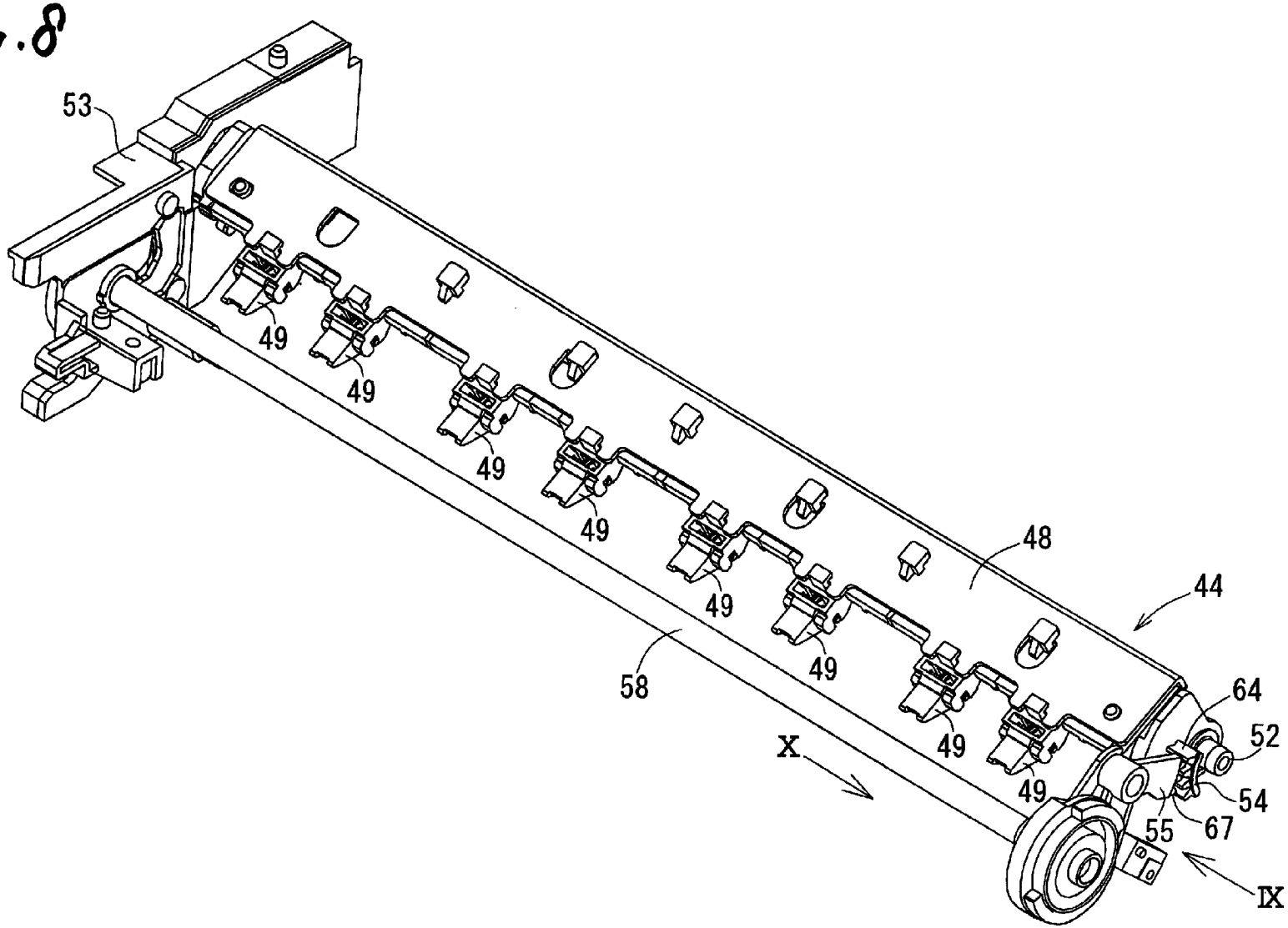
FIG. 8 is a perspective view of the drive mechanism of the path changeover unit according to the embodiment of the present invention.
Figure 9:
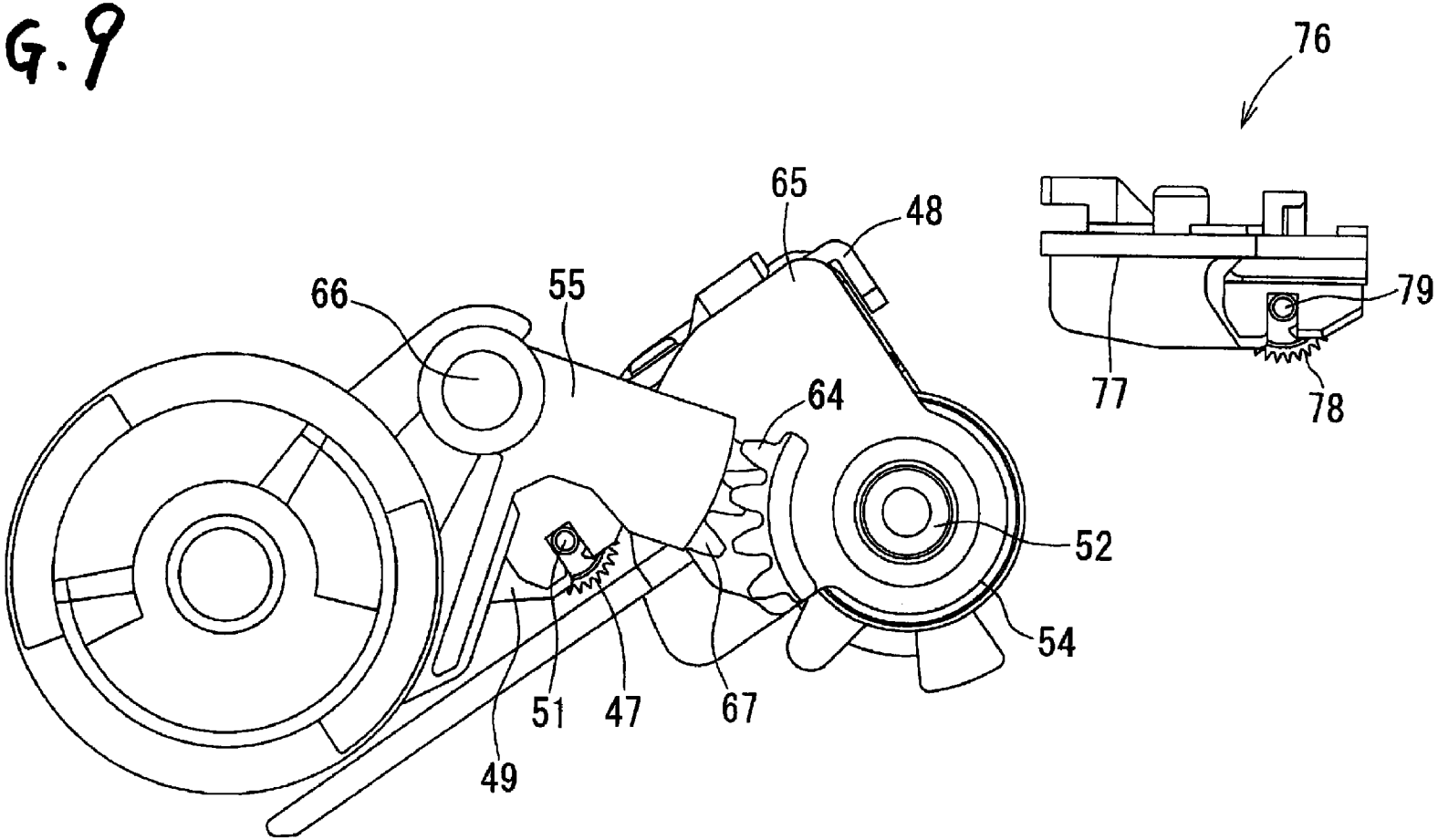
FIG. 9 is a side view of the drive mechanism when viewed in the direction of arrow IX shown in FIG. 8.
Figure 10:
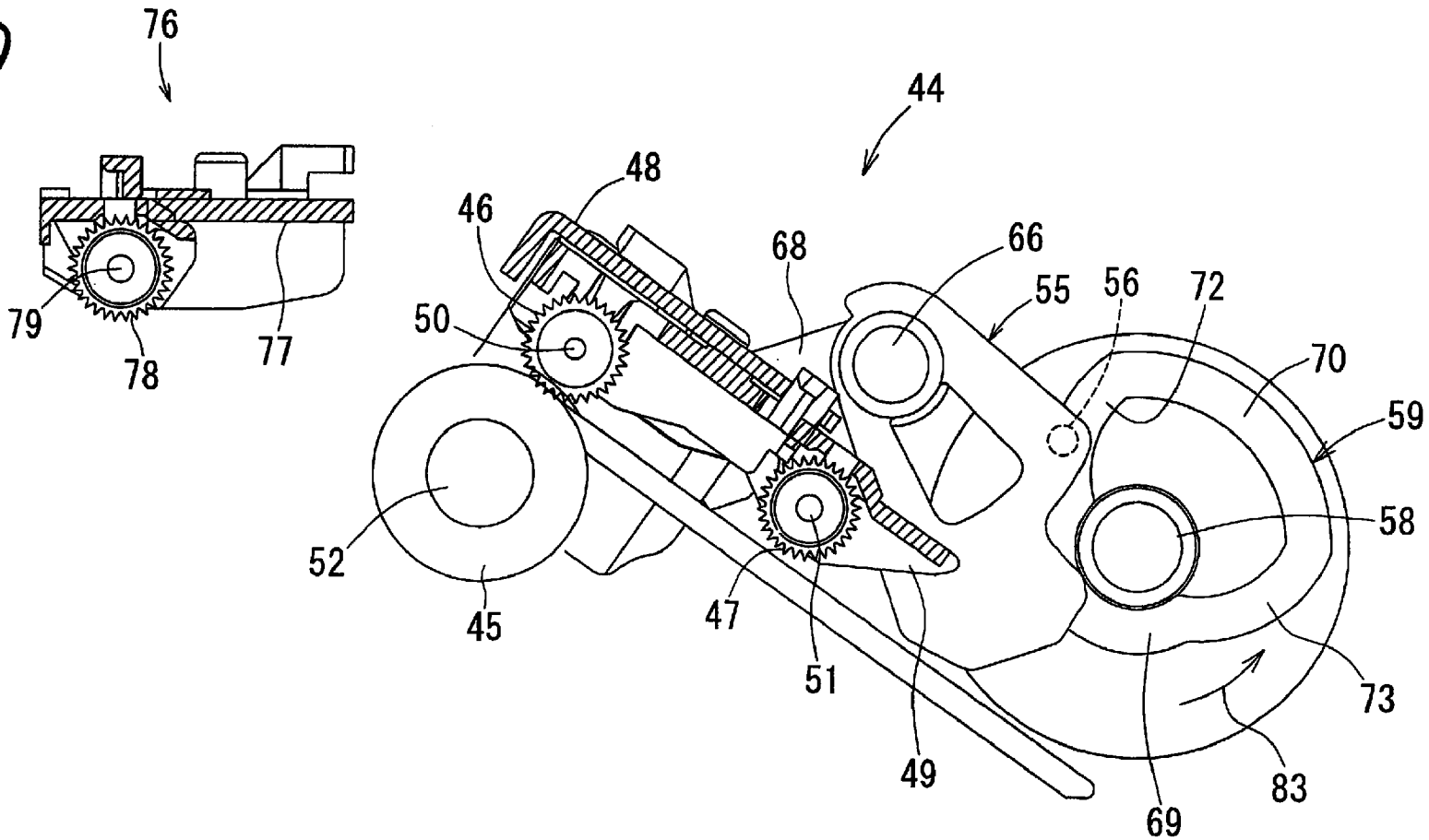
FIG. 10 is a partially-cross-sectional view of the drive mechanism when viewed in the direction of arrow X shown in FIG. 8.
Figure 11:
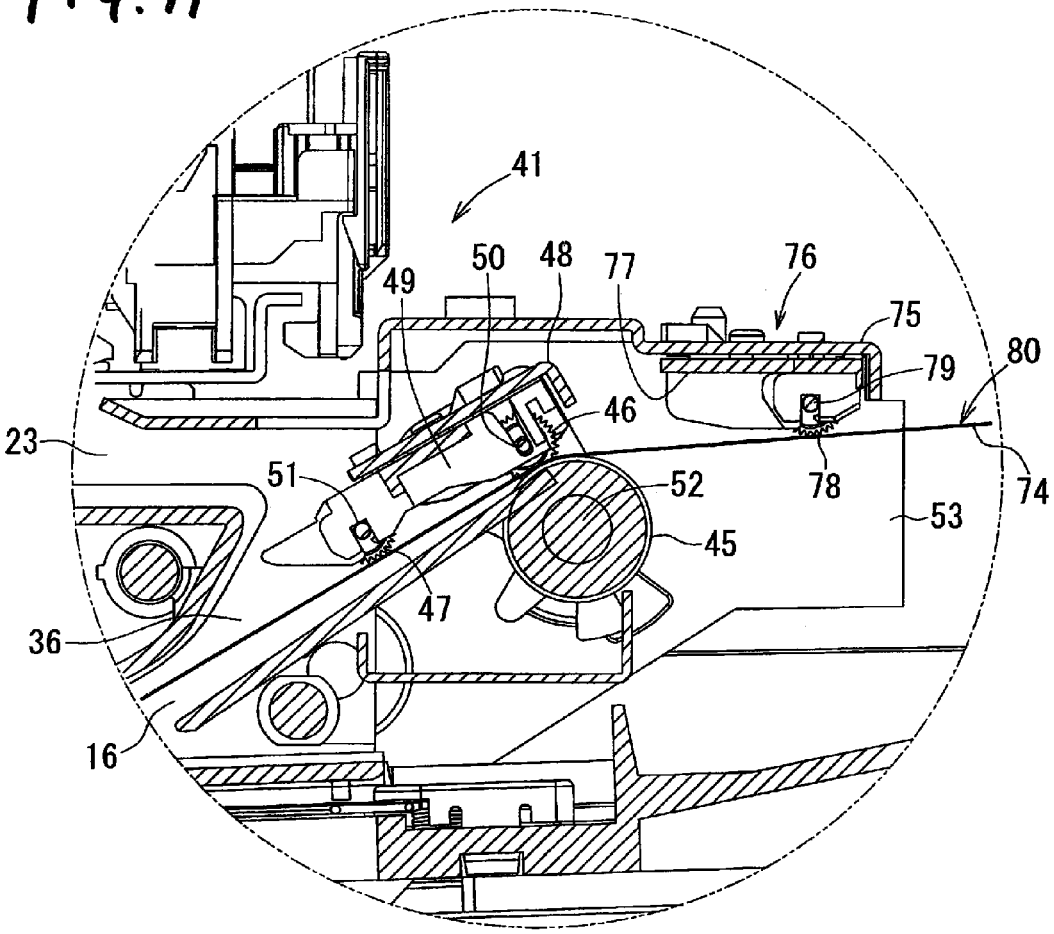
FIG. 11 is an enlarged view of the principal portion shown in FIG. 3.

FIG. 8 is a perspective view of the drive mechanism 44 of the path changeover unit 41 achieved when the frame 48, the sub-frames 49, the second rollers 46, and the auxiliary rollers 47 are rotated. FIG. 9 is a side view of the drive mechanism when viewed in the direction of arrow IX shown in FIG. 8, and FIG. 10 is a side view of the drive mechanism when viewed in the direction of arrow X shown in FIG. 8. FIG. 11 is an enlarged view of the principal portion shown in FIG. 3, showing a state where the path changeover unit 41 has rotated around the center axis 52.

As shown in FIG. 7, when the guide plate 57 is rotated, the pins 56 relatively move along the guide grooves 59. In particular, when the pins 56 slide along the joint grooves 72 and 73, the pins 56 move in a radial direction of the guide plate 57. Therefore, when the guide plate 57 is rotated clockwise (in the direction of an arrow 82) in FIG. 7, each of the pins 56 moves in sequence of the joint groove 72, the large circular-arc portion 70, and the joint groove 73. As a result, the drive gears 55 are rotated clockwise in FIG. 6. Consequently, the follower gears 54 rotate counterclockwise around the center axis 52 in FIG. 6. Since the follower gears 54 are coupled to the frame 48 as mentioned previously, the frame 48, the sub-frames 49, the second rollers 46, and the auxiliary rollers 47 are integrally rotated around the center axis 52 as a result of rotation of the follower gears 54, to thus enter states shown in FIGS. 8 to 10. When the guide plate 57 are rotated counterclockwise (in the direction of an arrow 83) in FIG. 10 from the states shown in FIGS. 8 through 10, the pins 56 move in sequence of the joint groove 72, the large circular-arc portions 70, the joint groove 73. Therefore, the drive gears 55 rotate counterclockwise in FIG. 9. As a result, the follower gears 54 rotate clockwise around the center axis 52 in FIG. 9.

At this time, the frame 48, the sub-frames 49, the second rollers 46, and the auxiliary rollers 47 are rotated around the center axis 52. Therefore, as shown in FIGS. 4 and 11, the second rollers 46 roll over a circumferential surface of the first roller 45. In the present embodiment, the position of the path changeover unit 41, such as that shown in FIG. 4, is defined as a "recording medium discharge position." The position of the path changeover unit 41, such as that shown in FIG. 11, is defined as a "recording medium inversion position." When the path changeover unit 41 is positioned at the recording medium discharge position, a recording sheet conveyed along the conveying path 23 is delivered to the sheet discharging tray 21. When the path changeover unit 41 is positioned at the recording medium discharge position, a tangent line to the first roller 45 or the second roller 46 at a contact point of the first roller 45 and the second roller 46 extends along the conveying path. When the path changeover unit 41 is positioned at the recording medium inversion position, the recording sheet 74 is returned upstream in the conveying direction, as shown in FIG. 11, whereby the recording sheet is guided to the inversion guide portion 16. For example, when the path changeover unit 41 is positioned at the recording medium inversion position, a tangent line to the first roller 45 or the second roller 46 at a contact point of the first roller 45 and the second roller 46 extends along the inversion guide portion 16. When the path changeover unit 41 changes from the recording medium discharge position to the recording medium inversion position, the auxiliary roller 47 guides the recording sheet 74 while holding the recording sheet 74 toward the inversion guide portion 16.

(2-6 Guide Unit)

As shown in FIGS. 4 and 11, the guide unit 76 is disposed downstream of the first roller 45 and the second rollers 46 (or the path changeover unit 41) in the conveying direction. A support plate 75 is attached to each of the body frame 53, and a guide unit 76 is provided on each of the support plates 75. The guide unit 76 includes a base portion 77 fixed to a lower surface of the support plate 75 and a guide roller 78 supported by the base portion 77. The base portion 77 includes a spindle 79, and the guide rollers 78 are rotatably supported by the spindle 79. In the present embodiment, the guide rollers 78 are formed in the shape of a spur.

The guide unit 76 is disposed at a predetermined location. Specifically, the guide unit 76 comes into contact with a record surface of the recording sheet 74 when the recording sheet 74 is in the middle of being delivered to the inversion guide portion 16 as a result of rearward rotation of the first roller 45 and the second rollers 46. Further, when the first roller 45 and the second rollers 46 forwardly rotates, to thus send the recording sheet 74 to the sheet discharging tray 21, the guide unit 76 does not come into contact with the recording sheet 74. Specifically, the guide unit 76 is disposed at a position where the guide unit 76 does not contact an imaginary line 82 (defined as "an imaginary sheet transporting path") that interconnects points of contact between the first roller 45 and the second rollers 46 and a point of contact between the discharge roller 62 and the spur roller 63.

As will be described later, the recording sheet 74 is delivered to the inversion guide portion 16 while the orientation of conveyance of the recording sheet is changed. The orientation of a portion of the recording sheet 74 located downstream with respect to the first roller 45 and the second rollers 46 is attempted to be changed to a direction parallel to the inversion guide portion 16 due to stiffness of the recording sheet 74. However, the guide rollers 78 come into contact with a record surface of the recording sheet 74, thereby bending the recording sheet 74. Therefore, the recording sheet 74 is wrapped around the first roller 45 and the second rollers 46, so that the recording sheet 74 is delivered to the inversion guide portion 16 without fail.

3. Advantages of the Multi Function Device of the Embodiment

As shown in FIG. 3, the recording sheet fed from the sheet feeding tray 20 is conveyed along a direction of arrow 14, and the recording unit 24 records an image on one side of the recording sheet. The recording sheet is nipped by the first roller 45 and the second roller 46 of the path changeover unit 41. When an image is to be recorded only on one side of the recording sheet, the path changeover unit 41 is positioned at the recording sheet discharge position as shown in FIG. 4. The first roller 45 and the second roller 46 forwardly rotate, whereby the recording sheet is discharge to the sheet discharging tray 21.

When an image is recorded on the other side of the recording sheet, the recording sheet is conveyed as follows. First, the path changeover unit 41 is positioned at a recording sheet discharge position, and the first roller 45 and the second roller 46 forwardly while nipping the recording sheet. As a result, the recording sheet is conveyed toward the sheet discharging tray 21. When the trailing end of the recording sheet has reached the specified position upstream of the auxiliary roller 47; that is, when a trailing end 81 of the recording sheet 74 has reached the auxiliary roller 47, the path changeover unit 41 is changed to a recording sheet inversion position. As a result, the trailing end 81 of the recording sheet 74 is pressed by the auxiliary roller 47 and oriented toward the inversion guide portion 16. By means of rearward rotation of the first roller 45 and the second roller 46, the conveying direction of the recording sheet 74 is changed and delivered to the inversion guide portion 16.

When changed to the recording medium inversion position, the path changeover unit 41 pivots around the center axis 52 of the first roller 45. Specifically, the second roller 46 rolls over the circumferential surface of the first roller 45 while nipping the recording sheet 74, and the auxiliary roller 47 presses the recording sheet 74. In other words, the second roller 46 rollers over the circumferential surface of the first roller 45 so as to wrap the recording sheet 74 around the circumferential surface of the first roller 45. As a result, the orientation of the recording sheet 74 is readily changed toward the inversion guide portion 16.

The recording sheet 74 sent to the inversion guide portion 16 is sent to the conveying path 23 by means of the feed roller 25 and again sent to the recording unit 24. Since the conveying path 23 is formed in the shape of the letter U as mentioned previously, an image is recorded on the other side of the recording sheet 74. The recording sheet 74 with images recorded on both sides thereof is nipped between the first roller 45 and the second roller 46 of the path changeover unit 41 and sent to the sheet discharging tray 21 as a result of forward rotation of the first roller 45 and the second roller 46.

According to the multi function device 10 of the present embodiment, when the recording sheet 74 with an image recorded on its one side is sent to the inversion guide portion 16, the auxiliary roller 47 presses the trailing end 81 of the recording sheet 74 while the second roller 46 is rolling over the circumferential surface of the first roller 45, to thus wrap the recording sheet 74 around the first roller 45. Therefore, the recording sheet 74 is reliably nipped by the first roller 45 and the second roller 46 without an increase in the drive force of the first roller 45 and the second roller 46. Since an increase in the drive force of the first roller 45 and the drive force of the second roller is unnecessary, there is no necessity for adoption of a large motor or the like for conveying the recording sheet 74, and prevention of occurrence of a break in the recording sheet 74 and miniaturization of the multi function device 10 are realized.

When the trailing end 81 of the recording sheet 74 is nipped by the first roller 45 and the second roller 46, the first roller 45 and the second roller 46 are rearwardly rotated. As a result, the conveying direction of the recording sheet 74 is changed, and the recording sheet enters the inversion guide portion 16. At this time, a portion of the recording sheet 74 located downstream of the first roller 45 and the second roller 46 is attempted to be changed to a direction parallel to the inversion guide portion 16 due to stiffness of the recording sheet 74. However, in the present embodiment, the guide roller 78 contacts the recording surface of the recording sheet 74, thereby deflecting the recording sheet. As a result, the recording sheet is wrapped around the first roller 45 and the second roller 46. Consequently, the recording sheet 74 is delivered to the inversion guide portion 16 without fail.

The recording sheet 74 sent to the inversion guide portion 16 is sent to the conveying path 23 by means of the feed roller 25 and again sent to the recording unit 24. Since the conveying path 23 is formed in the shape of the letter U as mentioned previously, an image is recorded on the other side of the recording sheet 74. The recording sheet 74 with images recorded on both sides thereof is nipped between the first roller 45 and the second roller 46 of the path changeover unit 41 and sent to the sheet discharging tray 21 as a result of forward rotation of the first roller 45 and the second roller 46. At this time, the guide unit 76 does not contact the recording sheet 74, and hence conveyance resistance does not increase.

According to the multi function device 10 of the present embodiment, when the recording sheet 74 with an image recorded on its one side is sent to the inversion guide portion 16, the guide unit 76 presses the end 83 of the recording sheet 74, to thus wrap the recording sheet 74 around the first roller 45. Therefore, the recording sheet 74 is reliably sent to the inversion guide portion 16. Moreover, when the recording sheet 74 is discharged, the guide unit 76 does not contact the recording sheet 74, and hence conveyance resistance can be diminished.

In particular, in the present embodiment, the recording sheet 74 sent to the inversion guide portion makes roll-contact with the guide roller 70. Consequently, there is an advantage of conveyance resistance of the recording sheet 74 being reduced. In addition, the guide roller 78 is formed in the shape of a spur, and hence deterioration of a recorded image, which would otherwise be caused when the guide roller 78 contacts the recording sheet 74, is prevented.

Since the guide unit 76 is placed at a location where the guide unit does not contact the imaginary line 82, the guide roller 78 does not contact the recording sheet 74 when the recording sheet 74 is discharged to the sheet discharging tray 21. Consequently, deterioration of a recorded image is prevented.

When the recording sheet 74 is sent to the inversion guide portion 16, the auxiliary roller 47 presses the end 81 of the recording sheet 74 while the second roller 46 is rolling over the circumferential surface of the first roller 45, to thus wrap the recording sheet 74 around the first roller 45. Therefore, the recording sheet 74 is reliably delivered to the inversion guide portion 16 without involvement of an increase in drive force of the first roller 45 and the second roller 46. Since an increase in drive force of the first roller 45 and the second roller 46 is unnecessary, there is no necessity for adoption of a large motor, or the like, for conveying the recording sheet 74, and miniaturization of the multi function device 10 is realized.

In the present embodiment, since the second roller 46 is elastically urged toward the first roller 45, there is an advantage of the recording sheet 74 being more reliably nipped and conveyed by the first roller 45 and the second roller 46.

Moreover, the auxiliary roller 47 and the second roller 46 are formed in the shape of a spur. Hence, when the auxiliary roller 47 presses the recording sheet 74 and when the recording sheet 74 is discharged to the sheet discharging tray 21, deterioration of an image recorded on the recording sheet 74, which would otherwise be caused as a result of the image contacting the auxiliary roller 47 and the second roller 46, is prevented.

In the present embodiment, since the second roller 46 is elastically urged toward the first roller 45, there is an advantage of the recording sheet 74 being more reliably nipped and conveyed by the first roller 45 and the second roller 46.

Moreover, the auxiliary roller 47 and the second roller 46 are formed in the shape of a spur. Hence, when the auxiliary roller 47 presses the recording sheet 74 and when the recording sheet 74 is discharged to the sheet discharging tray 21, deterioration of an image recorded on the recording sheet 74, which would otherwise be caused as a result of the image contacting the auxiliary roller 47 and the second roller 46, is prevented.

In the present embodiment, when a change arises in the position of the path changeover unit 41, the second roller 46 rolls over the circumferential surface of the first roller 45. However, the first roller 45 may also be configured so as to roll over the circumferential surface of the second roller 46. In this case, when the recording sheet 74 with an image recorded on its one side is sent to the inversion guide portion 16, the auxiliary roller 47 presses the rear end 81 of the recording sheet 74 while the second roller 46 is rolling over the circumferential surface of the first roller 45, to thus wrap the recording sheet 74 around the first roller 45. At this time, the recording sheet 74 is pressed against the first roller 45 and the second roller 46 by means of stiffness of the recording sheet 74. Consequently, the recording sheet 74 is reliably delivered to the inversion guide portion 16 while being nipped by the first roller 45 and the second roller 46, without an increase in the drive force of the first roller 45 and the second roller 46. Since an increase in the drive force of the first roller 45 and the second roller 46 is unnecessary, there is no necessity for adoption of a large motor, or the like, for conveying the recording sheet 74, and occurrence of a break in the recording sheet 74 is prevented, and miniaturization of the multi function device 10 is not hindered. Further, in the present embodiment, although the second roller 46 is pressed toward the first roller 45 by means of the elastic member, the first roller 45 may also be elastically urged toward the second roller 46.

What is claimed is:

1. An image recording apparatus comprising:

a conveying path on which a recording medium is allowed to be conveyed in a conveying direction;

a feeding unit configured to feed the recording medium to the conveying path;

a recording unit disposed in the conveying path and configured to record an image on the recording medium;

a sheet discharging portion disposed downstream of the recording unit with respect to the conveying direction;

an inversion guide portion that connects a first portion of the conveying path positioned downstream of the recording unit to a second portion of the conveying path positioned upstream of the recording unit; and a path changeover unit disposed at the first portion of the conveying path and swingable between a recording medium discharge position and a recording medium inversion position, the path changeover unit comprising:

a roller pair comprising a first roller and a second roller and configured to nip the recording medium and to perform a forward rotation and a rearward rotation; and a third roller disposed upstream of the roller pair with respect to the conveying direction, wherein the path changeover unit is swingable around one of the roller pair, wherein the first roller and the third roller are supported by a frame of the path changeover unit, and the frame is configured to rotate with respect to a main body of the image recording apparatus, wherein, when the path changeover unit is positioned at the recording medium discharge position, the forward rotation of the roller pair allows the recording medium nipped by the roller pair to be sent to the discharge portion, wherein, when the path changeover unit is positioned at the recording medium inversion position, the rearward rotation of the roller pair allows the recording medium nipped by the roller pair to be sent to the inversion guide portion, wherein, when the path changeover unit swings from the recording medium discharge position to the recording medium inversion position, the roller pair and the third roller of the path changeover unit guide the recording medium and change the conveying direction of the recording medium from a direction toward the first portion of the conveying path to a direction toward the inversion guide portion.

2. The image recording apparatus according to claim 1, further comprising an elastic member that urges one of the roller pair toward the other of the roller pair.

3. The image recording apparatus according to claim 1, wherein the third roller is a spur.

4. The image recording apparatus according to claim 1, wherein the recording unit is configured to record the image on a surface of the recording medium, and one of the roller pair opposing a the surface of the recording medium is a spur.

5. The image recording apparatus according to claim 1, wherein the third roller is configured to move with respect to said one of the roller pair in response to a positional change of the path changeover unit.

6. The image recording apparatus according to claim 5, wherein, when the path changeover unit is positioned at the recording medium discharge position, the third roller is positioned along the conveying path.

7. The image recording apparatus according to claim 5, wherein, when the path changeover unit is positioned at the recording medium inversion position, the third roller is positioned along the inversion guide portion.

8. The image recording apparatus according to claim 1, wherein one of the roller pair is relatively movable along a circumference of the other of the roller pair in response to a positional change of the path changeover unit.

9. The image recording apparatus according to claim 8, wherein, when the path changeover unit is positioned at the recording medium discharge position, a tangent line to one of the roller pair at a contact point of the roller pair extends along the conveying path.

10. The image recording apparatus according to claim 8, wherein, when the path changeover unit is positioned at the recording medium inversion position, a tangent line to one of the roller pair at a contact point of the roller pair extends along the inversion guide portion.

11. The image recording apparatus according to claim 1, wherein a circumference of the third roller contacts a tangent line to the roller pair at a contact point of the roller pair.

12. The image recording apparatus according to claim 1, further comprising a guide disposed downstream of the path changeover unit with respect to the conveying direction, wherein the guide is positioned so that the guide contacts with a recording surface of the recording medium when the recording medium is sent to the inversion guide portion as a result of rearward rotation of the roller pair.

13. The image recording apparatus according to claim 12, wherein the guide comprises a guide roller configured to come into roll-contact with the recording medium.

14. The image recording apparatus according to claim 13, wherein the guide roller is a spur.

15. The image recording apparatus according to claim 12, further comprising a pair of discharge rollers disposed between the recording unit and the path changeover unit with respect to the conveying path, wherein the guide is disposed at a position which does not contact an imaginary line connecting a contact point of the pair of discharge rollers and a contact point of the pair of rollers.

16. An image recording apparatus comprising:

a conveying path on which a recording medium is allowed to be conveyed in a conveying direction;

a feeding unit configured to feed the recording medium to the conveying path;

a recording unit disposed in the conveying path and configured to record an image on the recording medium;

a sheet discharging portion disposed downstream of the recording unit with respect to the conveying direction;

an inversion guide portion that connects a first portion of the conveying path positioned downstream of the recording unit to a second portion of the conveying path positioned upstream of the recording unit; and a path changeover unit disposed at the first portion of the conveying path and swingable between a recording medium discharge position and a recording medium inversion position, the path changeover unit comprising:

a roller pair comprising a first roller and a second roller and configured to nip the recording medium and to perform a forward rotation and a rearward rotation; and a third roller disposed upstream of the roller pair with respect to the conveying direction, wherein the path changeover unit is swingable around one of the roller pair, wherein, when the path changeover unit is positioned at the recording medium discharge position, the forward rotation of the roller pair allows the recording medium nipped by the roller pair to be sent to the discharge portion, wherein, when the path changeover unit is positioned at the recording medium inversion position, the rearward rotation of the roller pair allows the recording medium nipped by the roller pair to be sent to the inversion guide portion, and wherein the path changeover unit comprises a support member rotatable around a first axis of the first roller, and the support member rotatably supports the second roller and the third roller.

17. The image recording apparatus according to claim 16, further comprising a drive mechanism configured to change a position of the path changeover unit, the drive mechanism comprises:

a drive gear rotatable around a second axis; and a driven gear configured to mesh with the drive gear attached to the support member to be rotatable around the first axis.

18. The image recording apparatus according to claim 17, wherein the drive gear comprises:

an arm attached to the second axis; and a tooth portion provided on the arm and configured to mesh with the driven gear.

19. The image recording apparatus according to claim 18, wherein the drive gear further comprises:

a pin provided on the arm and extending in a direction perpendicular to a rotation direction of the arm;

a rotatable drive shaft; and a guide plate attached to the rotatable drive shaft and having a groove that is annularly formed around the rotatable drive shaft, wherein the pin is slidable along the groove.

20. The image recording apparatus according to claim 19, wherein the groove has:

a first arc portion formed around the rotatable drive shaft;

a second arc portion formed around the rotatable drive shaft and having a larger radius than the first arc portion;

joint portions that connect ends of the first arc portion and ends of the second arc portion.

21. An image recording apparatus comprising:

a conveying path on which a recording medium is allowed to be conveyed in a conveying direction;

a feeding unit configured to feed the recording medium to the conveying path;

a recording unit disposed in the conveying path and configured to record an image on the recording medium;

a sheet discharging portion disposed downstream of the recording unit with respect to the conveying direction;

an inversion guide portion that connects a first portion of the conveying path positioned downstream of the recording unit to a second portion of the conveying path positioned upstream of the recording unit;

a path changeover unit disposed at the first portion and comprising a roller pair comprising a first roller and a second roller and configured to nip the recording medium and to perform a forward rotation and a rearward rotation, the forward rotation that allows the recording medium nipped by the roller pair to be sent to the discharge portion, and the rearward rotation that allows the recording medium nipped by the roller pair to be sent to the inversion guide portion, and a third roller disposed upstream of the roller pair with respect to the conveying direction; and a guide disposed downstream of the path changeover unit with respect to the conveying direction, wherein the path changeover unit is swingable around one of the roller pair, wherein the first roller and the third roller are supported by a frame of the path changeover unit, and the frame is configured to rotate with respect to a main body of the image recording apparatus, wherein the guide is positioned so that the guide contacts with a recording surface of the recording medium when the recording medium is sent to the inversion guide portion as a result of rearward rotation of the roller pair, and that is non-contact with the recording surface of the recording medium when the recording medium is sent to the sheet discharging portion as a result of forward rotation of the roller pair, wherein, when the roller pair switches from the forward rotation to the rearward rotation, the roller pair guide the recording medium and change the conveying direction of the recording medium from a direction toward the first portion of the conveying path to a direction toward the inversion guide portion.

22. The image recording apparatus according to claim 21, wherein the guide comprises a guide roller configured to come into roll-contact with the recording medium.

23. The image recording apparatus according to claim 22, wherein the guide roller is a spur.

24. The image recording apparatus according to claim 21, further comprising a pair of discharge rollers disposed between the recording unit and the path changeover unit with respect to the conveying path, wherein the guide is disposed at a position which does not contact an imaginary line connecting a contact point of the pair of discharge rollers and a contact point of the roller pair.

25. The image recording apparatus according to claim 21, wherein the recording unit is configured to record the image on a surface of the recording medium, and one of the roller pair opposing the surface of the recording medium is a spur.

26. The image recording apparatus according to claim 21, wherein the path changeover unit is swingable around one of the roller pair to be configured to movable between a recoding medium discharge position and a recording medium inversion position.

27. The image recording apparatus according to claim 26, wherein the path changeover unit comprises a third roller disposed upstream of the roller pair with respect to the conveying direction.

28. The image recording apparatus according to claim 26, wherein the guide is positioned to contact with the recording medium when the path changeover unit is positioned at the recording medium inversion position and when the roller pair nips the recording medium in a state where a predetermined length of the recording medium remains downstream of the roller pair with respect to the conveying direction.

* * * * *